US007086462B2

(12) United States Patent
Ruttley et al.

(10) Patent No.: US 7,086,462 B2
(45) Date of Patent: Aug. 8, 2006

(54) WELLBORE ANCHOR TOOL

(75) Inventors: David J. Ruttley, Marrero, LA (US); Henry P. Boudet, Belle Chasse, LA (US)

(73) Assignee: Deltide Fishing and Rental Tools, Inc., Harvey, LA (US)

( * ) Notice: Subject to any disclaimer, the term of this patent is extended or adjusted under 35 U.S.C. 154(b) by 0 days.

(21) Appl. No.: 10/861,740

(22) Filed: Jun. 4, 2004

(65) Prior Publication Data

US 2005/0269073 A1 Dec. 8, 2005

(51) Int. Cl.
*E21B 23/01* (2006.01)

(52) U.S. Cl. ..... 166/216; 166/118; 166/214

(58) Field of Classification Search ..... 166/118, 166/210, 214, 211, 206
See application file for complete search history.

(56) References Cited

U.S. PATENT DOCUMENTS 3,861,465 A * 1/1975 Mignotte ..... 166/255.1
4,576,230 A * 3/1986 Tapp et al. ..... 166/382
4,949,792 A * 8/1990 Rubbo et al. ..... 166/382

OTHER PUBLICATIONS

Instruction Manual for Bowen Internal Cutters, 7 pages including cover.

* cited by examiner

*Primary Examiner*—Zakiya W. Bates
(74) *Attorney, Agent, or Firm*—Keaty Professional Law Corporation

(57) ABSTRACT

An anchor assembly for a downhole tool has upper and lower frictional engagement member for engaging with an inner wall of the casing. The upper frictional members are spring-tensioned, while the lower frictional engagement members slide, to certain degrees, in relation to a longitudinal axis of the anchor assembly. At the same time conical engagement between the lower frictional members and the supporting surface causes the lower frictional members to extend outwardly and engage the inner surface of the casing. As a result, the working tool, for instance a sand cutter secured to the anchor assembly is stabilized in the casing, and an even cut may be performed.

21 Claims, 7 Drawing Sheets

WELLBORE ANCHOR TOOL

BACKGROUND OF THE INVENTION

This invention relates to downhole anchoring tools, and more particularly to a well bore anchor that may be used for stabilizing a sand cutter and similar equipment in the well bore during a cutting operation.

In well operations, sometimes a well must be abandoned and plugged. The government regulations require that a casing be cut at a certain depth below the surface. Sand cutters have been conventionally used for performing the cutting operation. It was noted that when the cutting is performed at the depth of about 100 feet, the pressures downhole tend to push and excite the nozzle of the sand cutter and move it out of alignment by a small distance, such as a quarter of an inch. However, this small distance is critical in the tight confines of a casing. The string supporting the cutter is energized and causes it to move from the required alignment. As a result, the cut created by the sand cutter is no longer circular but rather resembles a spiral, such that the end of the cut does not necessary meet the beginning of the cut.

The deeper the casing cutting operations are performed, the more pronounced the problem becomes. With deeper wells, more hydraulic lines need to be run, more feed of the pipes downhole, and more possibility of misalignment. One of the solutions was to place a centralizing plate around the cutting tool to keep the cutter from moving into misalignment. However, the centralizing plate has to be carefully inserted and then properly aligned at the desired depth. Even then, a possibility exists for the hydraulic force imparted on the cutter to unseat the plate, which will result in an uneven cut.

The present invention contemplates elimination of drawbacks associated with the prior art and provision of an anchoring tool, which positively engages the inner walls of the casing allowing a cutting tool, or other necessary equipment to be securely connected to the top or bottom of the tool for performing the required operations in the well bore.

SUMMARY OF THE INVENTION

It is, therefore, an object of the present invention to provide a well bore anchor tool, which is adapted for engaging the inner wall of the casing, and stabilize any attached equipment within the well bore.

It is another object of the present invention to provide a well bore anchor tool, which frictionally engages the inner wall of the casing by slidable expanding slips once the anchoring tool reaches the desired depth.

These and other objects of the present invention are achieved through a provision of a well bore anchor tool, which comprises an elongated hollow mandrel, an upper sub carried by the mandrel, a plurality of upper frictional members secured on the upper sub for frictionally engaging an inner wall of a casing within the well bore, a bottom sub carried by the mandrel, and a plurality of lower frictional members detachably engageable with the bottom sub. Each of the bottom frictional members has an inclined inner surface matching an inclined surface of recesses formed along an upper exterior portion of the bottom sub. A downward movement of the mandrel causes the bottom frictional member to move outwardly in relation to the bottom sub and frictionally engage the casing inner wall.

BRIEF DESCRIPTION OF THE DRAWINGS

Reference will now be made to the drawings, wherein like parts are designed by like numerals, and wherein.

DETAILED DESCRIPTION OF THE PREFERRED EMBODIMENT

Figure 1:
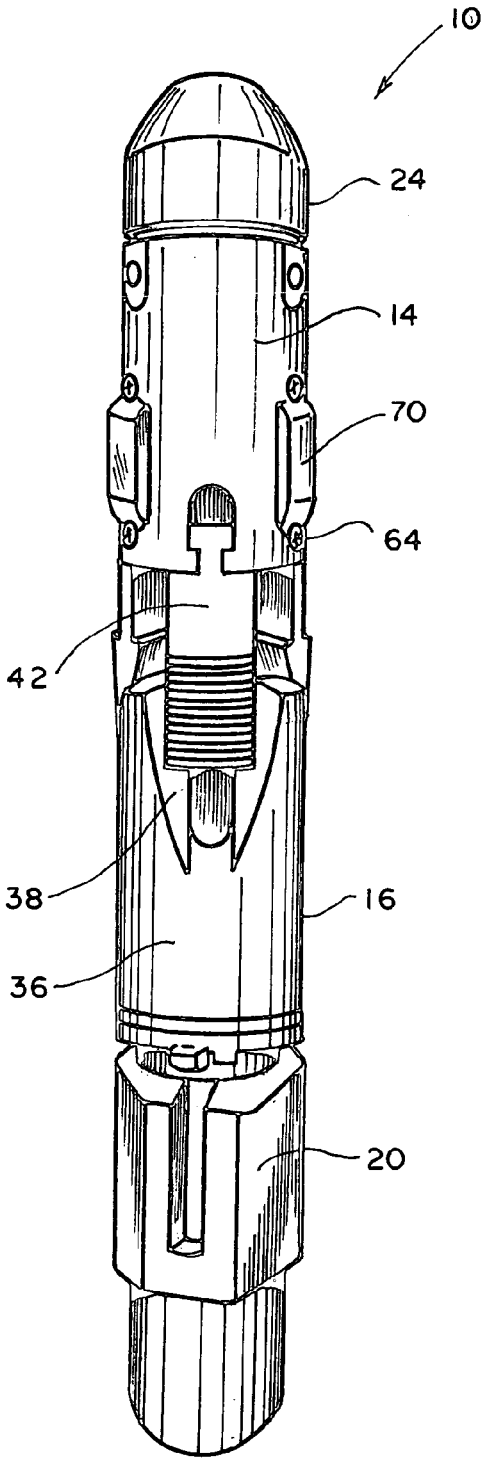
FIG. 1 is a perspective view of the anchor tool in accordance with the present invention.
Figure 2:
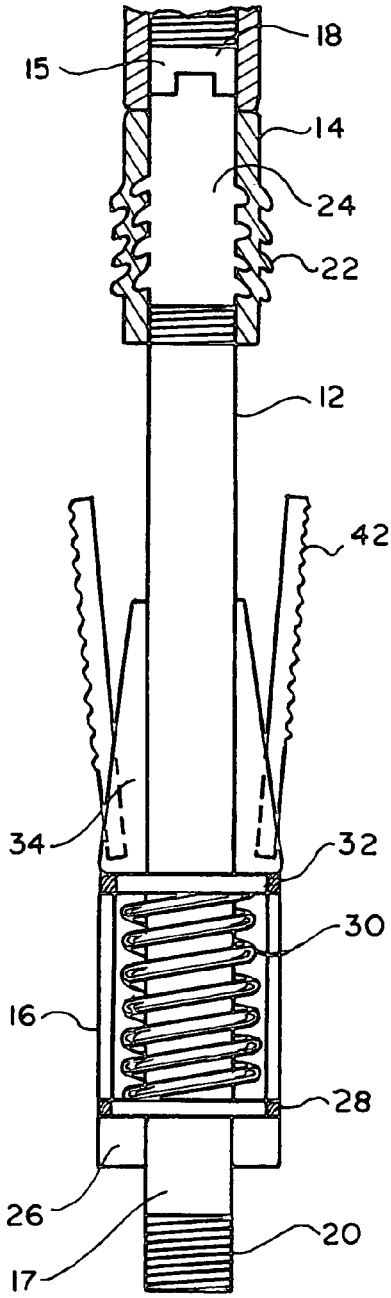
FIG. 2 is a perspective detail view of a mandrel showing an upper sub and a wicker sleeve.
Figure 4:
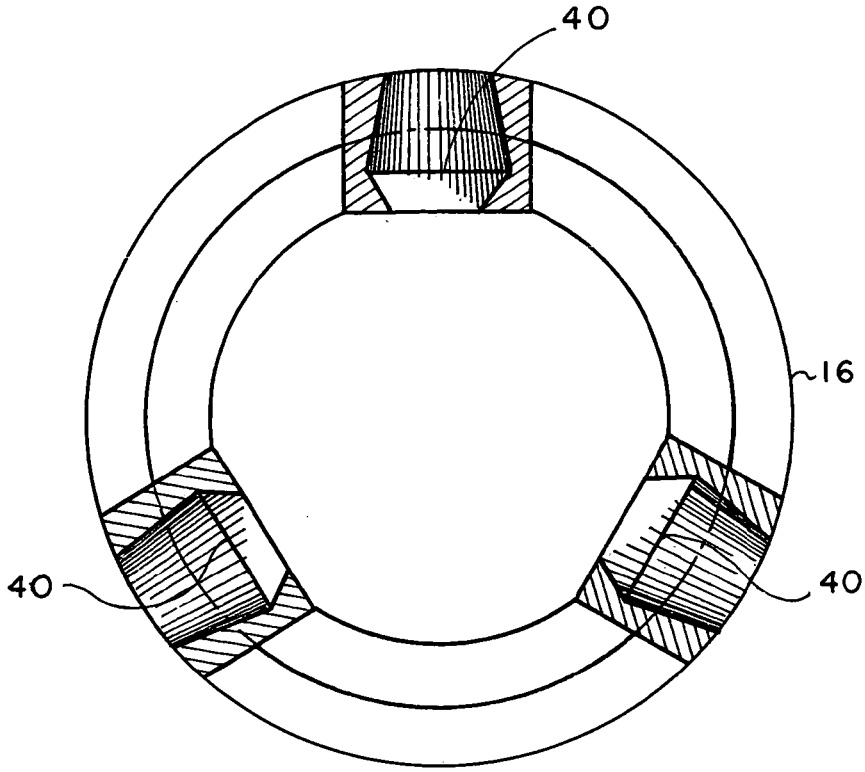
FIG. 4 is a top view of the bottom sub showing dovetail-shaped tracks for receiving bottom frictional members, or slips.
Figure 5:
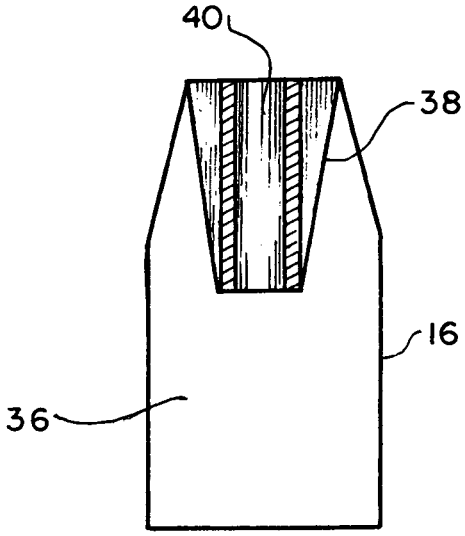
FIG. 5 is a detail view illustrating a side view of the bottom sub, or cone.

Turning now to the drawings in more detail, numeral 10 designates the well bore anchor tool in accordance with the present invention. The anchor tool 10 comprises an elongated central mandrel 12 having an upper sub 14 and a bottom sub 16 secured thereto. A top sub 15 has exterior threads 18 which allow securing of a work string thereto. A lower sub 17 is similarly provided with exterior threads 20 that allow securing of a downhole tool, for instance a sand cutter thereto.

A wicker sleeve 24 is mounted in a threadable engagement with the upper part of the mandrel 12. The wicker sleeve has exterior threads 22 formed along at least a lower portion the wicker sleeve 24. The upper part of the wicker sleeve 24 has a smooth exterior surface. A plurality of wicker dogs 94 is threadably engaged with the threads 22, as will be explained in more detail hereinafter.

An annular collar 26 is secured about a lower portion of the mandrel 12. A split thrust 28 rests with its bottom surface on the collar 26. The split thrust 28 has a threaded portion, which is threadably engaged with the bottom sub 16 when the bottom frictional members 42 are in their extended position engaging the inner casing wall. A main compression spring 30 urges against the top surface of the split thrust 28.

A spring stop 32 is mounted in a surrounding relationship over the mandrel body 12 and provides an upper stop for the main spring 30.

Figure 9:
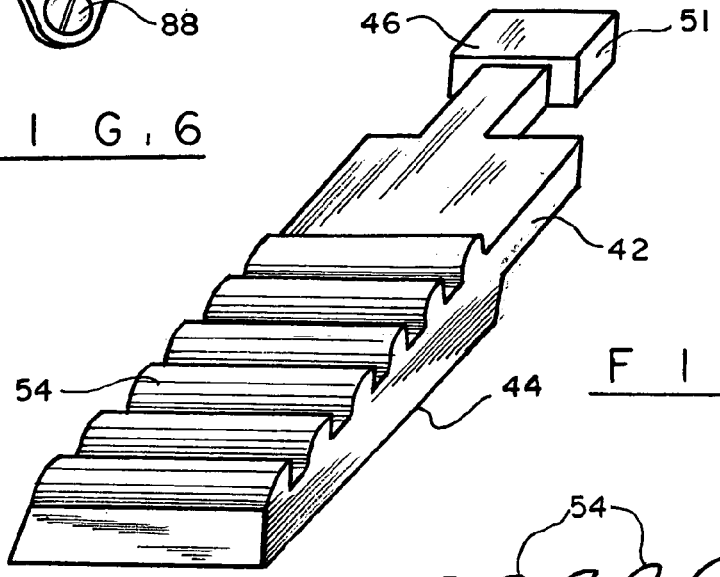
FIG. 9 is a detail front view of the slip.
Figure 10:
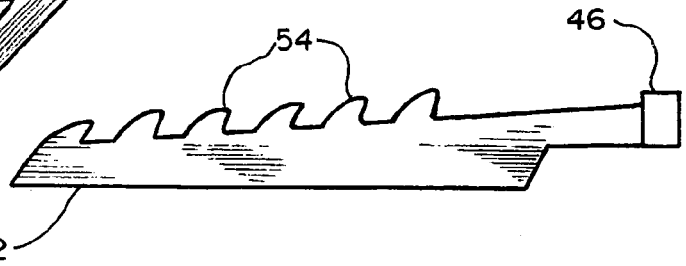
FIG. 10 is a detail side view of the slip.
Figure 8:
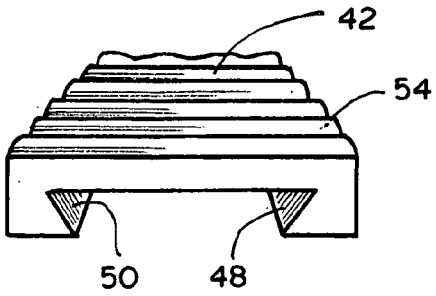
FIG. 8 is a detail view of a slip showing dovetail-shaped channel formed on the inner surface of the slip.
Figure 11:
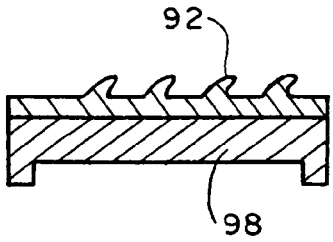
FIG. 11 is a cross-sectional view of a wicker dog.
Figure 15:
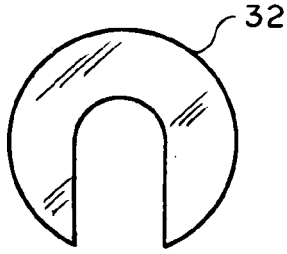
FIG. 15 is a detail top view of a main spring stop.
Figure 12:
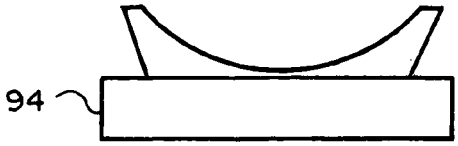
FIG. 12 is a detail bottom view of the wicker dog.
Figure 14:
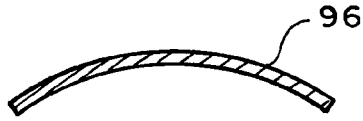
FIG. 14 is cross-sectional view of a leaf, or drag spring.
Figure 13:
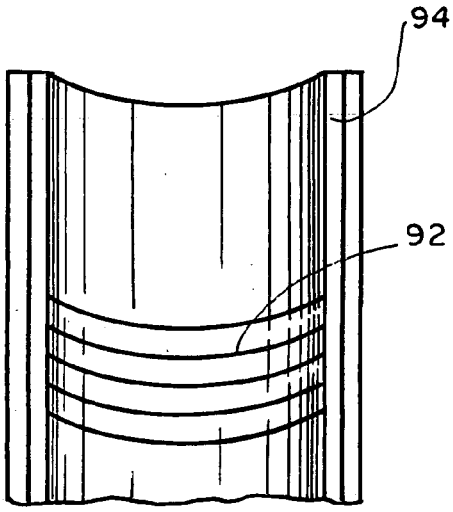
FIG. 13 is a detail front view of the wicker dog.
Figure 16:
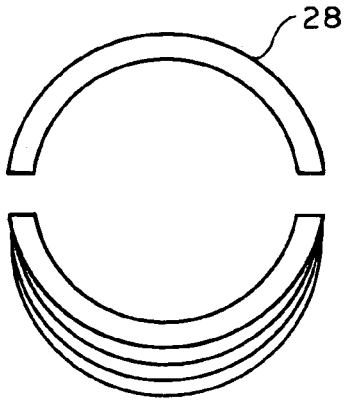
FIG. 16 is a detail top view of a split thrust.
Figure 17:
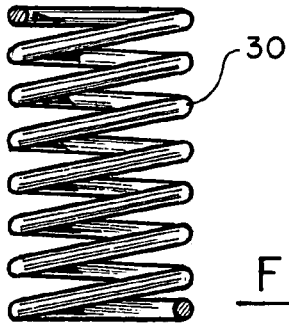
FIG. 17 is a perspective view of a main spring and FIG 18 is a cross-sectional view of a wicker dog retainer ring.
Figure 18:
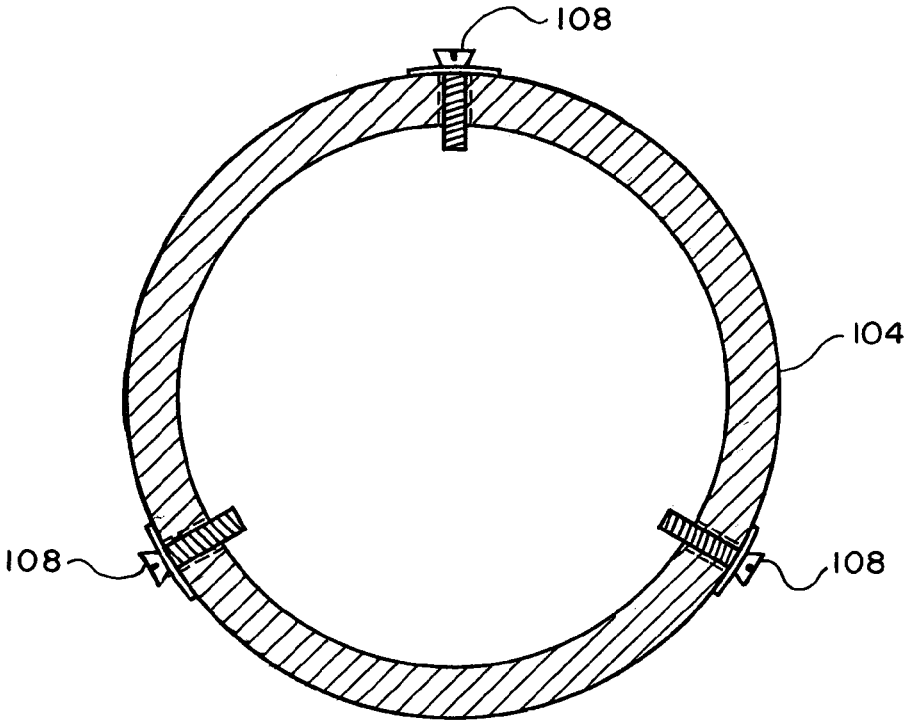

The bottom sub 16 has an upper part 34, which extends above the spring stop 32, and a lower cylindrical portion 36. The upper part 34 is provided with a plurality, for instance three, recesses 38. Each recess 38 has a dovetail-shaped cross section and a bottom surface 40. Each of the recesses 38 defines a dovetail-shaped track for receiving a bottom frictional member, or slip 42 in a sliding engagement therein. As shown in FIGS. 8–10, each slip 42 comprises a bottom part 44 and a T-shaped upper securing member 46. A dovetail-shaped cutout 48 is formed in an inner surface 50 of each slip 42. The cutout 48 matches the recess 38 in the lower sub 16, allowing the slip 42 to move up and down, to some degree, along the track 38.

Figure 3:
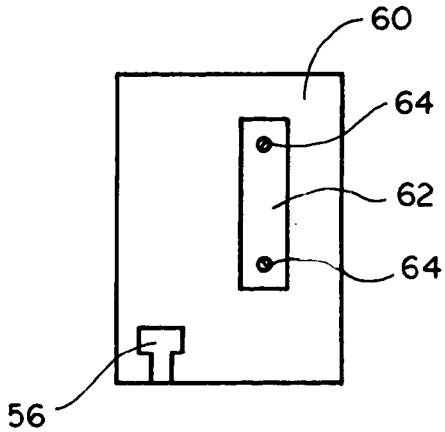
FIG. 3 is a detail front view of an upper sub.

The exterior surface of each slip 42 is provided with a plurality of projections, or serrations 54 which facilitate frictional engagement of the slip 42 within a casing. The T-shaped securing member 46 fits into a matchingly profiled cutout 56 formed adjacent a lower edge of the upper sub 14 (FIGS. 1 and 3).

The upper sub 14 wiper is formed as a cylindrical member with a plurality of rectangularly-shaped slots 62 for receiving an upper frictional engagement member, or wiper block 70 therein. A pair of openings 64 are formed in the top and bottom of the slot 62 for receiving retainer screws therein. The upper sub 14 may have three or four such slots 62, each adapted for receiving a wiper block 70 in a detachable engagement therein.

Figure 6:
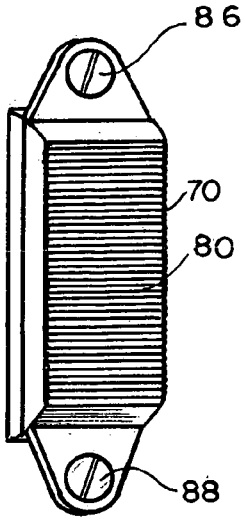
FIG. 6 is a detail front view of an upper frictional member, or wiper block.
Figure 7:
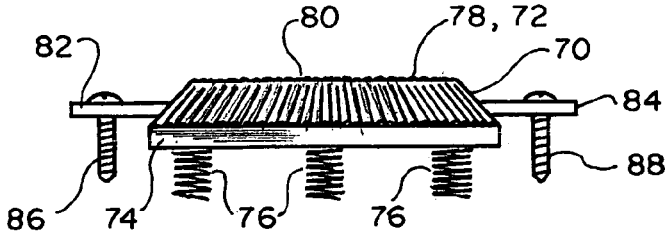
FIG. 7 is a detail side view of a wiper block showing compression springs.

As can be better seen in FIGS. 6 and 7, each wiper block 70 comprises a main body 72, which has a generally trapezoidal cross-section. An inner surface 74 of the body 72 carries a plurality of compression springs 76, which extend outwardly from the base 74 and can be three or four in number. An outer surface 78 of the body 72 is provided with projections 80, which facilitate frictional engagement of the wiper blocks 70 with the inner wall of the casing. Each wiper block 70 has an upper retaining plate 82 and a lower retaining plate 84. A retainer screw 86 extends through the retainer plate 82 and an opposing retainer screw 88 extends through a retainer plate 84. The screws 86 and 88 engage within respective openings 64.

Figure 19:
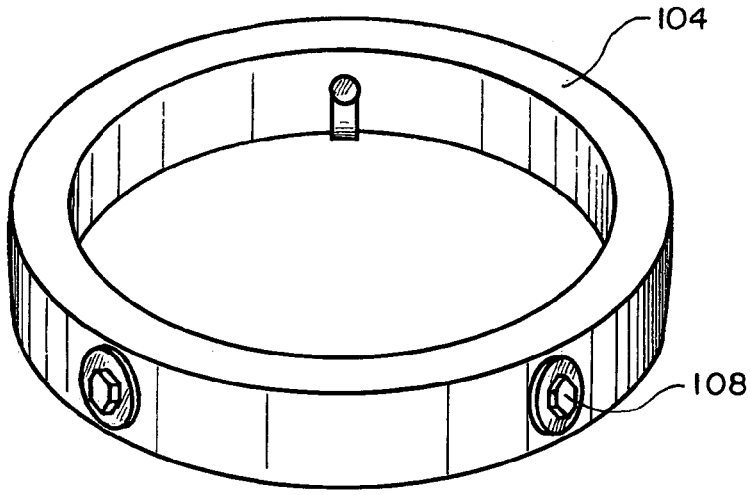
FIG. 19 is a detail perspective view of the wicker dog retainer ring.

As can be better seen in FIG. 19, the wicker sleeve 24 has exterior threads 22 which extend along the bottom portion of the wicker sleeve 24. Matching threads 92 are formed on a wicker dog 94. A drag spring, or leaf spring 96 is mounted in contact with an exterior surface 98 of the wicker dog 94. The upper sub 14 is formed as a hollow cylinder with a plurality of recesses formed on the interior wall thereof. Each wicker dog 94 fits into a respective recess by sliding the wicker dog 94 vertically from the top of the sub 14 into a respective recess such that a bottom 100 of the wicker dog 94 rests on an internal shoulder 102 formed along the inner wall of the upper sub 14.

Figure 20:
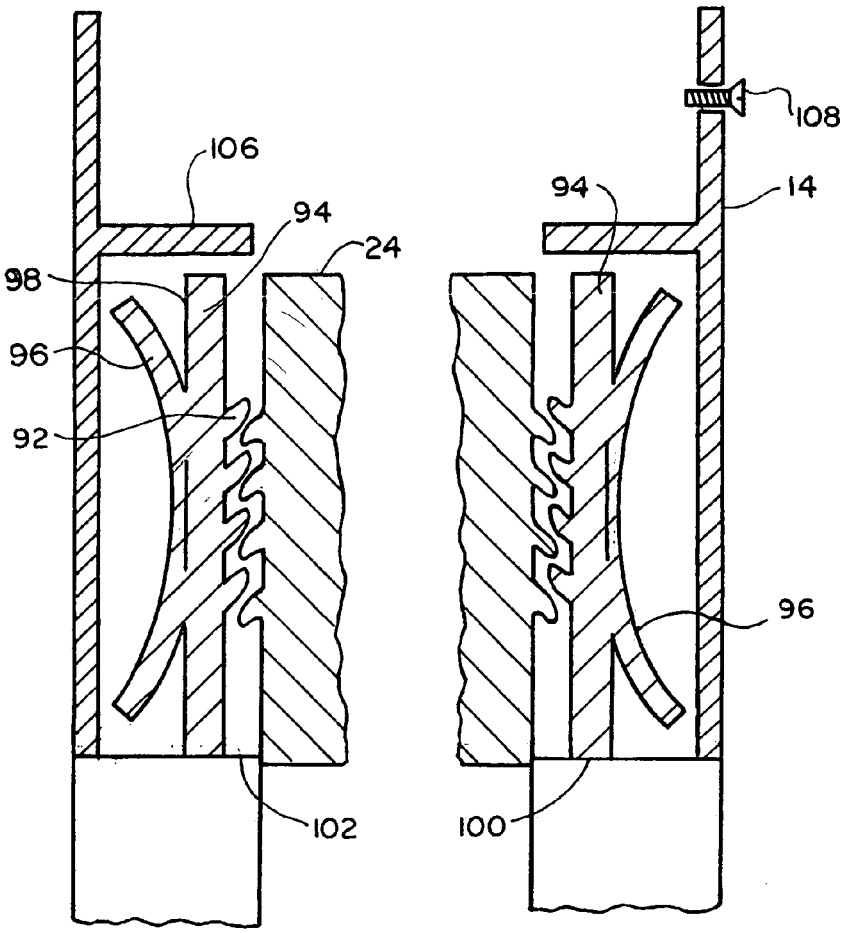
FIG. 20 is a detail sectional view of a wicker sleeve, wicker dog and the drag spring mounted in the upper sub.
Figure 21:
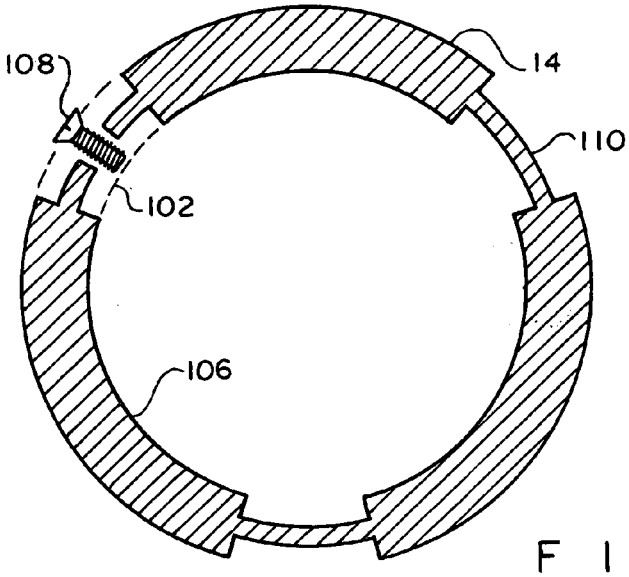
FIG. 21 is a cross-sectional view of the upper sub.
Figure 22:
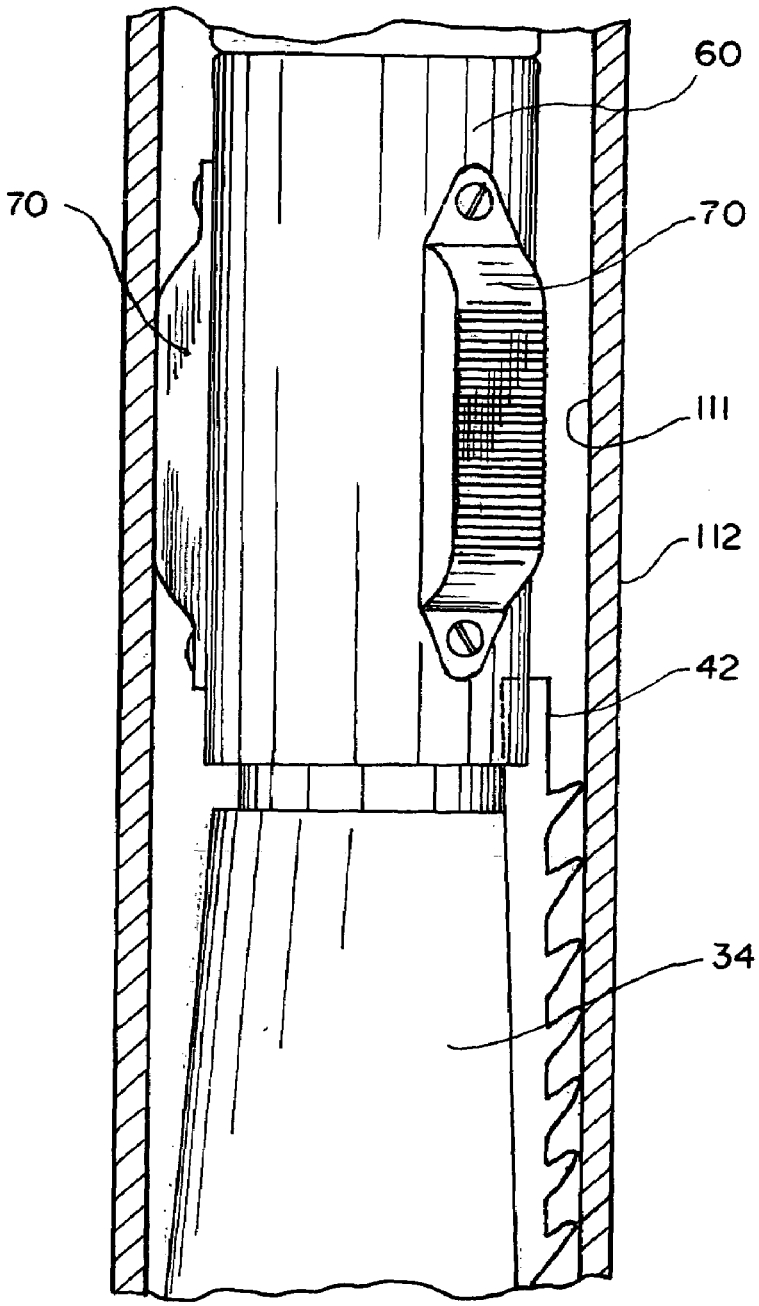
FIG. 22 is a detail perspective view showing engagement of the inner casing wall by the upper and bottom frictional engagement members.

A retainer ring 104 is positioned on top of the wicker dogs 94 and rests on top of an upper shoulder 106 formed inside the retainer member 60. The retainer ring 104 is retained in place by a plurality of screws 108, which pass through the wall of the upper sub 14, as can be seen in FIG. 19 and 20. The head of the screw 108 is positioned outside of the upper sub 14. If desired, the exterior surface of the upper sub 14 can be provided with recesses 110 to allow the heads of the screws 108 to be recessed and not contact the inner wall of a casing.

In operation, if the anchor tool 10 is to be used with a sand cutter, the sand cutting head is made up to the bottom of the tool 10 by engaging with the threads 20. The anchor tool assembly with the sand cutter is lowered into the well bore on a connected work string. Once the cutting depth has been achieved, right hand rotation is applied to the string while slowly lowering the work string downhole. The wiper blocks 70 and the leaf springs 96 resist rotation by maintaining friction on the inner wall 111 of the casing 112. The wicker sleeve 24 eventually disengages from the wicker dogs 94. Continued lowering of the work string allows the slips 42 to move downward and out to anchor the tool 10 inside the inner wall 111 of the casing 112.

The main spring 30 is partially compressed to maintain a uniform pressure on the assembly while the sand cut is being made from the inside of the casing 112. Normally one rotation per hour is applied to the work string. It may take two or three rotations to complete the cut to the casing cylinder. After the cut has been made, the anchor assembly 10 is released by picking up on the work string and retrieving the tool from the well bore. The upward movement allows the slips 42 to shift into a release position out of a frictional engagement with the casing inner wall 111.

If desired, the anchor tool 10 can be run in an upside down position. The sand cutter will then be attached to the threads 18. Once the cutting depth is achieved, left hand rotation is applied while the work string is slowly raised. The wiper blocks 70 and the leaf springs 96 resist rotation and lifting while maintaining friction on the wall of the casing 112. The upward movement disengages the wicker sleeve 24 from the wicker dogs 94. A continued raising of the work string allows the slips 42 to move downward and outward to anchor the tool 10 firmly to the inside wall 111 of the casing 112. An upward pull of 5,000 to 10,000 pounds is to be applied and maintained to the work string throughout the cutting procedure. The main spring 30 is partially compressed to maintain uniform pressure on the assembly while the cut is being made. Normally one rotation per hour is applied to the work string. It may take two to three rotations to complete the sand cut once the cut has been performed, the tool 10 is released by simply lowering the work string. This allows the slips 42 to shift into a release position and the tool 10 can be retrieved from the well bore together with the sand cutter attached thereto.

The tool 10 may be successfully used for aligning and stabilizing a variety of downhole equipment during wellbore operations. It will be understood that the exemplary application of the apparatus for use with a sand cutter is but of many potential applications where anchoring of a tool at a certain depth is required.

Many changes and modifications can be made in the design of the present invention without departing from the spirit thereof. We, therefore pray that our rights to the present invention be limited only by the scope of the appended claims.

We claim:

1. A well bore anchor tool apparatus, comprising:

an elongated hollow mandrel;

a first means carried by said mandrel for frictionally engaging an inner wall of a casing mounted adjacent a top of the mandrel;

a means for retaining said first means for frictionally engaging the casing inner wall, in a detachable engagement with the mandrel, said retaining means comprising a wicker sleeve mounted in a threadable engagement with the mandrel, a plurality of wicker dogs threadably engaging an exterior surface of the wicker sleeve, and a retainer member mounted in a substantially surrounding relationship about said wicker dogs, said retainer member being provided with recesses in an exterior surface thereof for receiving therein, said means for retaining said first means for frictionally engaging the casing inner wall;

a second means carried by the mandrel for frictionally engaging the inner wall of the casing mounted below said first means for frictionally engaging the casing inner wall, said second means being adapted for movement between a first retracted position and a second released position in frictional contact with the casing inner wall.

2. The apparatus of claim 1, wherein said first means for frictionally engaging the casing inner wall comprises a plurality of wiper blocks equidistantly spaced from each other and each having an outer surface extending outwardly in relation to said mandrel.

3. The apparatus of claim 1, wherein said first means for frictionally engaging the casing inner wall comprises a plurality of wiper blocks equidistantly spaced from each other and detachably secured within the recesses formed in said retainer member.

4. The apparatus of claim 3, wherein a drag spring is fitted between each of said wicker dogs and said retainer member for resisting rotational force applied to said anchor tool when the tool is rotated and lowered into a well bore.

5. The apparatus of claim 3, wherein each of said wiper blocks carries a plurality of compression springs secured to an inner surface of a wiper block, said compression springs urging each of said wiper blocks outwardly in relation to the retainer member.

6. The apparatus of claim 3, wherein each of said wiper blocks has a contact surface carrying a plurality of projections to facilitate frictional engagement of each of the wiper blocks with the casing inner wall.

7. The apparatus of claim 3, wherein said retainer member is formed with an upper shoulder extending inwardly about at least a portion of the inner wall of the retainer member and a lower annular shoulder extending inwardly along the inner wall of the retainer member below said upper shoulder.

8. The apparatus of claim 7, wherein a retainer ring is positioned on said upper shoulder to prevent unseating of said wicker dogs.

9. The apparatus of claim 7, wherein a bottom surface of each of said wicker dogs is adapted for resting on said lower shoulder.

10. The apparatus of claim 1, wherein said second means for frictionally engaging the inner wall of the casing comprises a plurality of slidable slips, each of said slidable slips having an upper part fitted into a matchingly sized and shaped slot formed along a lower edge of the retainer member and an inclined inner surface.

11. The apparatus of claim 10, further comprising a bottom sub mounted on a lower portion of said mandrel.

12. The apparatus of claim 11, wherein said bottom sub has an upper part provided with a plurality of upwardly inclined recesses, and wherein said slips move outwardly into a frictional engagement with the casing inner wall when the inner surface of the slips slides within said inclined recesses as the tool is being lowered into a well bore.

13. The apparatus of claim 12, further comprising a main compression spring mounted between the mandrel and said bottom sub, in a surrounding relationship about the mandrel, said main compression, spring maintaining a uniform pressure on the slips while the tool is positioned in the well bore.

14. The apparatus of claim 11, further comprising an annular collar carried by the mandrel, and wherein a bottom of said bottom sub contacts said collar.

15. A well bore anchor tool apparatus, comprising: an elongated hollow mandrel; an upper sub carried by the mandrel; a plurality of upper frictional members for frictionally engaging an inner wall of a casing within the well bore, said upper frictional members being detachably compressively mounted on the upper sub; a bottom sub carried by the mandrel, said bottom sub having a plurality of recesses having inclined bottom surface; a plurality of lower frictional members detachably engageable with the bottom sub, each of said bottom frictional members having an inclined inner surface matching the inclined bottom surface of the recesses, and wherein downward movement of the mandrel causes the bottom frictional member to move outwardly in relation to the bottom sub and frictionally engage the casing inner wall.

16. The apparatus of claim 15, further comprising a means for retaining said upper frictional members in a detachable engagement with the mandrel.

17. The apparatus of claim 16, wherein said retaining means comprises a wicker sleeve mounted in a threadable engagement with the mandrel, a plurality of wicker dogs threadably engaging an exterior surface of the wicker sleeve, and a retainer member mounted in a substantially surrounding relationship about said wicker dogs, said retainer member being provided with recesses in an exterior surface thereof for receiving therein, said upper frictional members.

18. The apparatus of claim 17, further comprising a main compression spring mounted between the mandrel and the bottom sub, in a surrounding relationship about the mandrel, said main compression spring maintaining a uniform pressure on the slips while the tool is positioned in the well bore.

19. The apparatus of claim 17, wherein a drag spring is fitted between each of said wicker dogs and said retainer member for resisting rotational force applied to said anchor tool when the tool is rotated and lowered into a well bore.

20. The apparatus of claim 17, wherein each of said upper frictional members carries a plurality of compression springs secured to an inner surface of an upper frictional member, said compression springs urging each of said upper frictional members outwardly in relation to the retainer member.

21. The apparatus of claim 15, wherein a plurality of cutouts is formed adjacent a lower edge of the upper sub, and wherein an upper part of each of said lower frictional members fits into a matchingly sized and shaped cutout.

* * * * *